US011412912B2

(12) United States Patent
Boyer et al.

(10) Patent No.: US 11,412,912 B2
(45) Date of Patent: Aug. 16, 2022

(54) DISHWASHER WITH TUBULAR SPRAY ELEMENT SLIP RING ALIGNMENT

(71) Applicant: Midea Group Co., Ltd., Foshan (CN)

(72) Inventors: Joel Boyer, Louisville, KY (US); Robert M. Digman, Goshen, KY (US)

(73) Assignee: MIDEA GROUP CO., LTD., Foshan (CN)

( * ) Notice: Subject to any disclaimer, the term of this patent is extended or adjusted under 35 U.S.C. 154(b) by 232 days.

(21) Appl. No.: 17/027,204

(22) Filed: Sep. 21, 2020

(65) Prior Publication Data

US 2022/0087500 A1 Mar. 24, 2022

(51) Int. Cl.

*A47L 15/22* (2006.01)
*A47L 15/42* (2006.01)
*A47L 15/50* (2006.01)

(52) U.S. Cl.

CPC ..... *A47L 15/22* (2013.01); *A47L 15/4282* (2013.01); *A47L 15/50* (2013.01); *A47L 15/508* (2013.01)

(58) Field of Classification Search

None

See application file for complete search history.

(56) References Cited

U.S. PATENT DOCUMENTS 2,734,520 A 2/1956 Abresch
2,808,063 A 10/1957 Abresch et al.
2,907,335 A 10/1959 Abresch
2,992,779 A 1/1960 James et al.
2,939,465 A 6/1960 Kesling
2,956,572 A 10/1960 Levit et al.
2,973,907 A 3/1961 Abresch et al.
2,980,120 A 4/1961 Jacobs
3,006,557 A 10/1961 Jacobs
3,026,046 A 3/1962 Wickham et al.
3,044,842 A 7/1962 Abresch et al.
3,051,183 A 8/1962 Jacobs
3,077,200 A 2/1963 Guth
3,082,779 A 3/1963 Jacobs
3,088,474 A 5/1963 Leslie
3,101,730 A 8/1963 Harris et al.
3,115,306 A 12/1963 Graham
3,178,117 A 4/1965 Hanifan
3,192,935 A 7/1965 Hanifan
3,210,010 A 10/1965 Delapena
3,324,867 A 6/1967 Freese
3,348,775 A 10/1967 Flame (Continued)

FOREIGN PATENT DOCUMENTS

CN 2094961 U 2/1992
CN 2395683 Y 9/2000

(Continued)

OTHER PUBLICATIONS

U.S. Patent and Trademark Office, Office Action issued in U.S. Appl. No. 16/298,007 dated Oct. 19, 2020.

(Continued)

*Primary Examiner* — Levon J Shahinian
(74) *Attorney, Agent, or Firm* — Middleton Reutlinger

(57) ABSTRACT

A dishwasher and method therefor utilize a slip ring alignment arrangement to facilitate control over a rotational position of a rack-mounted tubular spray element or other rotatable conduit that is capable of being decoupled from a rotational drive.

20 Claims, 8 Drawing Sheets

(56) References Cited

U.S. PATENT DOCUMENTS

| | | | |
|---|---|---|---|
| 3,361,361 | A | 1/1968 | Schutte |
| 3,454,784 | A | 7/1969 | Wantz et al. |
| 3,538,927 | A | 11/1970 | Harald |
| 3,586,011 | A | 6/1971 | Mazza |
| 3,590,688 | A | 7/1971 | Brannon |
| 3,596,834 | A | 8/1971 | Cushing |
| 3,719,323 | A | 3/1973 | Raiser |
| 4,175,575 | A | 11/1979 | Cushing |
| 4,226,490 | A | 10/1980 | Jenkins et al. |
| 4,301,822 | A | 11/1981 | Dingler |
| 4,398,562 | A | 8/1983 | Saarem et al. |
| 4,657,188 | A | 4/1987 | Crane et al. |
| 4,718,440 | A | 1/1988 | Hawker et al. |
| 4,732,323 | A | 3/1988 | Jarvis et al. |
| 4,822,241 | A | 4/1989 | Jarvis et al. |
| 5,211,190 | A | 5/1993 | Johnson et al. |
| 5,226,454 | A | 7/1993 | Cabalfin |
| 5,341,827 | A | 8/1994 | Kim |
| 5,697,392 | A | 12/1997 | Johnson et al. |
| 5,725,002 | A | 3/1998 | Payzant |
| 5,752,533 | A | 5/1998 | Edwards |
| 5,927,616 | A | 7/1999 | Grise et al. |
| 6,053,185 | A | 3/2000 | Cirjak et al. |
| 6,431,188 | B1 | 8/2002 | Laszczewski, Jr. et al. |
| 6,612,009 | B1 | 9/2003 | Laszczewski, Jr. et al. |
| 6,694,990 | B2 | 2/2004 | Spanyer et al. |
| 6,869,029 | B2 | 3/2005 | Ochoa et al. |
| 7,055,537 | B2 | 6/2006 | Elick et al. |
| 7,210,315 | B2 | 5/2007 | Castelli et al. |
| 7,293,435 | B2 | 11/2007 | Elexpuru et al. |
| 7,445,013 | B2 | 11/2008 | VanderRoest et al. |
| 7,464,718 | B2 | 12/2008 | McIntyre et al. |
| 7,556,049 | B2 | 7/2009 | Oakes et al. |
| 7,587,916 | B2 | 9/2009 | Rizzetto |
| 7,594,513 | B2 | 9/2009 | VanderRoest et al. |
| 7,607,325 | B2 | 10/2009 | Elexpuru et al. |
| 7,650,765 | B2 | 1/2010 | Rizzetto |
| 7,914,625 | B2 | 3/2011 | Bertsch et al. |
| 7,935,194 | B2 | 5/2011 | Rolek |
| 8,136,537 | B2 | 3/2012 | Cerrano et al. |
| 8,161,995 | B2 | 4/2012 | Armstrong et al. |
| 8,191,560 | B2 | 6/2012 | Mallory et al. |
| 8,443,765 | B2 | 5/2013 | Hollis |
| 8,696,827 | B2 | 4/2014 | Ashrafzadeh et al. |
| 8,778,094 | B2 | 7/2014 | Blanchard et al. |
| 8,858,729 | B2 | 10/2014 | Buddharaju et al. |
| 8,900,375 | B2 | 12/2014 | Gnadinger et al. |
| 8,915,257 | B2 | 12/2014 | Büsing et al. |
| 8,932,411 | B2 | 1/2015 | Beaudet et al. |
| 8,978,674 | B2 | 3/2015 | Buesing |
| 8,985,128 | B2 | 3/2015 | Pyo et al. |
| 9,121,217 | B1 | 9/2015 | Hoffberg |
| 9,170,584 | B2 | 10/2015 | Lum et al. |
| 9,204,780 | B2 | 12/2015 | Francisco et al. |
| 9,220,393 | B2 | 12/2015 | Becker et al. |
| 9,241,604 | B2 | 1/2016 | Dries |
| 9,259,137 | B2 | 2/2016 | Boyer et al. |
| 9,265,400 | B2 | 2/2016 | Bigott |
| 9,307,888 | B2 | 4/2016 | Baldwin et al. |
| 9,326,657 | B2 | 5/2016 | Thiyagarajan |
| 9,480,389 | B2 | 11/2016 | Haft et al. |
| 9,492,055 | B2 | 11/2016 | Feddema |
| 9,532,700 | B2 | 1/2017 | Welch |
| 9,635,994 | B2 | 5/2017 | Boyer et al. |
| 9,655,496 | B2 | 5/2017 | Baldwin et al. |
| 9,915,356 | B2 | 3/2018 | Chang et al. |
| 9,958,073 | B2 | 5/2018 | Yang |
| 10,524,634 | B2 | 1/2020 | Digman |
| 10,531,781 | B2 | 1/2020 | Digman et al. |
| 10,631,708 | B2 | 4/2020 | Digman et al. |
| 10,765,291 | B2 | 9/2020 | Digman et al. |
| 2005/0011544 | A1 | 1/2005 | Rosenbauer et al. |
| 2005/0139240 | A1 | 6/2005 | Bong et al. |
| 2005/0241680 | A1 | 11/2005 | Noh |
| 2005/0241681 | A1 | 11/2005 | Hwang |
| 2006/0090778 | A1 | 5/2006 | Oakes et al. |
| 2006/0278258 | A1 | 12/2006 | Kara et al. |
| 2007/0215187 | A1 | 9/2007 | Koch et al. |
| 2008/0163904 | A1 | 7/2008 | Hwang |
| 2008/0271765 | A1 | 11/2008 | Burrows |
| 2008/0276975 | A1 | 11/2008 | Disch |
| 2009/0071508 | A1 | 3/2009 | Sundaram et al. |
| 2009/0090400 | A1 | 4/2009 | Burrows et al. |
| 2009/0145468 | A1 | 6/2009 | Chericoni |
| 2010/0043826 | A1 | 2/2010 | Bertsch et al. |
| 2011/0186085 | A1 | 8/2011 | Chen et al. |
| 2012/0060875 | A1 | 3/2012 | Fauth et al. |
| 2012/0175431 | A1 | 7/2012 | Althammer et al. |
| 2012/0291827 | A1 | 11/2012 | Buddharaju et al. |
| 2013/0000762 | A1 | 1/2013 | Buddharaju et al. |
| 2013/0068265 | A1 | 3/2013 | Gnadinger et al. |
| 2013/0137621 | A1 | 5/2013 | Kessler et al. |
| 2013/0319483 | A1 | 12/2013 | Welch |
| 2014/0059880 | A1 | 3/2014 | Bertsch et al. |
| 2014/0069470 | A1 | 3/2014 | Baldwin et al. |
| 2014/0345654 | A1 | 11/2014 | Cho et al. |
| 2014/0373876 | A1 | 12/2014 | Feddema |
| 2015/0007861 | A1 | 1/2015 | Azmi et al. |
| 2015/0266065 | A1 | 9/2015 | Savoia |
| 2016/0198928 | A1 | 7/2016 | Xu et al. |
| 2017/0135548 | A1 | 5/2017 | Swarnkar |
| 2017/0181599 | A1 | 6/2017 | Choi et al. |
| 2017/0224190 | A1 | 8/2017 | Sakthivel et al. |
| 2017/0265707 | A1 | 9/2017 | Roderick et al. |
| 2017/0273535 | A1 | 9/2017 | Roderick et al. |
| 2017/0354308 | A1 | 12/2017 | Choi et al. |
| 2018/0035863 | A1 | 2/2018 | Liu et al. |
| 2018/0084967 | A1 | 3/2018 | Ross et al. |
| 2018/0110397 | A1 | 4/2018 | Kim et al. |
| 2018/0132692 | A1 | 5/2018 | Dries |
| 2018/0168425 | A1 | 6/2018 | Wilson et al. |
| 2018/0192851 | A1 | 7/2018 | Gursoy et al. |
| 2018/0220870 | A1 | 8/2018 | Beshears, Jr. et al. |
| 2018/0333037 | A1 | 11/2018 | Roderick et al. |
| 2018/0360293 | A1 | 12/2018 | Boyer |
| 2019/0059688 | A1 | 2/2019 | Woo et al. |
| 2019/0099054 | A1 | 4/2019 | Digman et al. |
| 2019/0099056 | A1 | 4/2019 | Digman |
| 2019/0191959 | A1 | 6/2019 | Brightbill et al. |
| 2019/0290095 | A1 | 9/2019 | Wahlberg et al. |
| 2019/0307308 | A1 | 10/2019 | Haegermarck |
| 2020/0077868 | A1 | 3/2020 | Digman et al. |
| 2020/0085277 | A1 | 3/2020 | Digman et al. |
| 2020/0085278 | A1* | 3/2020 | Digman ..... A47L 15/4282 |
| 2020/0085279 | A1 | 3/2020 | Digman et al. |
| 2020/0107696 | A1 | 4/2020 | Digman et al. |
| 2020/0288940 | A1 | 9/2020 | Fawaz et al. |
| 2021/0251462 | A1 | 8/2021 | Boyer |
| 2021/0267430 | A1 | 9/2021 | Digman et al. |

FOREIGN PATENT DOCUMENTS

| | | | |
|---|---|---|---|
| CN | 1879547 | A | 12/2006 |
| CN | 101049224 | A | 10/2007 |
| CN | 101134198 | A | 3/2008 |
| CN | 201067392 | Y | 6/2008 |
| CN | 101795613 | A | 8/2010 |
| CN | 102307508 | A | 1/2012 |
| CN | 102370450 | A | 3/2012 |
| CN | 102512128 | A | 6/2012 |
| CN | 102940476 | A | 2/2013 |
| CN | 203447254 | U | 2/2014 |
| CN | 203749364 | U | 8/2014 |
| CN | 203763025 | U | 8/2014 |
| CN | 104433985 | A | 3/2015 |
| CN | 104523208 | A | 4/2015 |
| CN | 104757921 | A | 7/2015 |
| CN | 104840165 | A | 8/2015 |
| CN | 204671085 | U | 9/2015 |
| CN | 105147218 | A | 12/2015 |
| CN | 105147220 | A | 12/2015 |
| CN | 105231971 | A | 1/2016 |
| CN | 205094364 | U | 3/2016 |
| CN | 106574786 | A | 4/2017 |

(56) References Cited

FOREIGN PATENT DOCUMENTS

| | | | |
|---|---|---|---|
| CN | 105286746 | B | 2/2018 |
| CN | 108697298 | A | 10/2018 |
| CN | 109538865 | A | 3/2019 |
| DE | 3537184 | A1 | 4/1987 |
| DE | 20113227 | U1 | 10/2001 |
| DE | 10121083 | A1 | 10/2002 |
| DE | 10300501 | A1 | 7/2004 |
| DE | 202004013786 | U1 | 12/2004 |
| DE | 102008011743 | A1 | 9/2009 |
| DE | 202014010365 | U1 | 5/2015 |
| EP | 0559466 | A1 | 9/1993 |
| EP | 0679365 | A1 | 11/1995 |
| EP | 0764421 | A1 | 3/1997 |
| EP | 0786231 | A2 | 7/1997 |
| EP | 0864291 | A1 | 9/1998 |
| EP | 1132038 | A2 | 9/2001 |
| EP | 1136030 | A1 | 9/2001 |
| EP | 1238622 | A2 | 9/2002 |
| EP | 1252856 | A2 | 10/2002 |
| EP | 1632166 | A2 | 3/2006 |
| EP | 1758494 | A1 | 3/2007 |
| EP | 2452759 | A1 | 5/2012 |
| EP | 2636786 | A1 | 9/2013 |
| EP | 2059160 | B1 | 3/2015 |
| EP | 3222191 | A1 | 9/2017 |
| FR | 1473796 | A | 3/1967 |
| GB | 572623 | A | 10/1945 |
| GB | 2244209 | A | 11/1991 |
| JP | 2003339607 | A | 12/2003 |
| JP | 2014121353 | A | 7/2014 |
| KR | 100786069 | B1 | 12/2007 |
| KR | 200442414 | | 11/2008 |
| KR | 101173691 | B1 | 8/2012 |
| KR | 200464747 | Y1 | 1/2013 |
| WO | 2009008827 | A1 | 1/2009 |
| WO | 2016008699 | A1 | 1/2016 |
| WO | 2017022974 | A1 | 2/2017 |
| WO | 2018053635 | A1 | 3/2018 |
| WO | 2018107833 | A1 | 6/2018 |
| WO | 2018107834 | A1 | 6/2018 |
| WO | 2018107835 | A1 | 6/2018 |

OTHER PUBLICATIONS

Encyclo, "Keyed Connector—Definition—Encyclo", https://www.encyclo.co.uk/meaning-of-Keyed_connectors, 2020.

U.S. Patent and Trademark Office, Notice of Allowance issued in U.S. Appl. No. 16/132,125 dated Jun. 16, 2021.

U.S. Patent and Trademark Office, Final Office Action issued in U.S. Appl. No. 16/132,106 dated Jan. 7, 2021.

U.S. Patent and Trademark Office, Notice of Allowance issued in U.S. Appl. No. 16/298,007 dated May 19, 2021.

European Patent Office, Communication issued in Application No. 19859390.7, 9 pages, dated Aug. 24, 2021.

Electrolux Home Products, Inc. "Dishwasher Use & Care Guide 1500 Series with Fully Electronic Control" 2003.

SCRIBD, Sears Kenmore Elite 2013 Stainless Steel Tall Tub Dishwasher Service Manual, www.scribd.com, Retrieved on Dec. 5, 2018.

International Search Report and Written Opinion issued in Application No. PCT/CN2021/110536 dated Oct. 26, 2021.

U.S. Patent and Trademark Office, Final Office Action issued in U.S. Appl. No. 16/298,007 dated Feb. 24, 2021.

International Search Report and Written Opinion issued in Application No. PCT/CN2020/108004 dated Oct. 26, 2020.

U.S. Patent and Trademark Office, Office Action issued in U.S. Appl. No. 16/795,484 dated May 18, 2022.

* cited by examiner

DISHWASHER WITH TUBULAR SPRAY ELEMENT SLIP RING ALIGNMENT

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the shortcoming that they must spread the wash fluid over all areas equally to achieve a satisfactory result. In doing so, resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

A different approach to traditional spray arm systems utilizes one or more tubular spray elements to spray utensils within a dishwasher. A tubular spray element is a type of rotatable conduit that both conveys wash fluid along its length and ejects the wash fluid through various apertures disposed on an exterior surface thereof. A tubular spray element is generally formed of an elongated body and rotates about a longitudinal axis thereof, either in a controllable or uncontrollable fashion, e.g., based upon an electric drive, a hydraulic drive, or as a result of rotational forces imparted by the ejection of wash fluid from the tubular spray element.

Tubular spray elements, like spray arms and other types of sprayers, may be supported by dishwasher racks. As dishwasher racks are generally movable within a dishwasher for loading and unloading purposes, however, such rack-mounted sprayers generally rely on a docking system that removably couples such sprayers to a fluid supply. Particularly, with tubular spray elements, however, it may be desirable to control the rotational position of such tubular spray elements, e.g., to control the direction of spray therefrom, so it may be desirable in some instances to ensure that the rotational position of a tubular spray element can be controlled irrespective of whether the rotational position of a tubular spray element changes when it is decoupled from a docking system.

SUMMARY

The herein-described embodiments address these and other problems associated with the art by providing a dishwasher and method therefor that utilize a slip ring alignment arrangement to facilitate control over a rotational position of a rack-mounted tubular spray element or other rotatable conduit that is capable of being decoupled from a rotational drive.

Therefore, consistent with one aspect of the invention, a dishwasher may include a wash tub, a rack supported in the wash tub and movable between loading and washing positions, a tubular spray element supported by the rack for movement with the rack, the tubular spray element being rotatable about a longitudinal axis thereof and including a connector proximate an end thereof and one or more spray apertures extending through an exterior surface thereof, and a docking arrangement coupled to a wall of the wash tub and configured to engage with the connector of the tubular spray element when the rack is in the washing position to supply fluid to the tubular spray element. The docking arrangement may include a rotatable docking port rotatable about an axis of rotation and positioned to receive the connector of the tubular spray element when the rack is disposed in the washing position, and a docking port drive coupled to the rotatable docking port and configured to rotate the rotatable docking port such that when the connector of the tubular spray element is received in the rotatable docking port, the docking port drive rotates the tubular spray element while rotating the rotatable docking port. In addition, the tubular spray element and the rotatable docking port are coupled to one another through a slip ring alignment arrangement including first and second mating members respectively coupled to the connector of the tubular spray element and the rotatable docking port, the first and second mating members being movable along respective first and second circular paths within a common plane that is substantially transverse to the axis of rotation of the rotatable docking port when the connector of the tubular spray element is received within the rotatable docking port such that rotation of the rotatable docking port by the docking port drive in a first direction causes the first and second mating members to come into contact with one another to rotationally align the tubular spray element relative to the rotatable docking port and thereafter rotate the tubular spray element in the first direction while the first and second mating members are in contact with one another.

In some embodiments, the first and second mating members are sized and configured such that rotation of the rotatable docking port a full revolution establishes rotational alignment between the tubular spray element and the rotatable docking port irrespective of a rotational position of the tubular spray element when the connector is inserted into the rotatable docking port. Also, in some embodiments, the slip ring alignment arrangement enables the rotatable docking port to rotate relative to the tubular spray element prior to the first and second mating members coming into contact with one another. Further, in some embodiments, the docking port drive is configured to rotate the rotatable docking port at least a full revolution in the first direction after insertion of the connector of the tubular spray element into the rotatable docking port to establish rotational alignment between the tubular spray element and the rotatable docking port.

In some embodiments, the rotational alignment established from rotation of the rotatable docking port in the first direction is a first rotational alignment, and further rotation of the rotatable docking port after establishing the first rotational alignment in the first direction drives rotation of the tubular spray element in the first direction, and the docking port drive is further configured to rotate the rotatable docking port at least a full revolution in a second direction that is opposite the first direction after establishing the first rotational alignment between the tubular spray element and the rotatable docking port to bring different portions of the first and second mating members into contact with one another and thereby establish a second rotational alignment between the tubular spray element and the rotatable docking port.

In addition, in some embodiments, the first and second mating members each have first and second respective mating surfaces, the first mating surfaces of the first and second mating members configured to contact one another when the first rotational alignment is established and the second mating surfaces of the first and second mating members configured to contact one another when the second rotational alignment is established. In some embodiments, the docking port drive is configured to discretely direct the tubular spray element to each of a plurality of rotational positions about the longitudinal axis thereof, and the docking port drive is configured to reverse a rotational direction of the tubular spray element when the first rotational alignment is established by rotating the rotatable docking port a sufficient amount in the second direction to establish the second rotational alignment.

In addition, in some embodiments, the rotatable docking port includes a centering chamfer configured to center the tubular spray element in the rotatable docking port during insertion of the connector thereof. Moreover, in some embodiments, the centering chamfer is defined on a plurality of teeth extending in respective radial directions from the axis of rotation of the rotatable docking port and arranged in an annular array about a perimeter of the rotatable docking port, and the first mating member is sized and configured to fit between the plurality of teeth during insertion and removal of the connector of the tubular spray element into and out of the rotatable docking port. In some embodiments, the second mating member is disposed on one of the plurality of teeth, and the first mating member extends from an outer surface of the connector of the tubular spray element in a radial direction from the longitudinal axis of the tubular spray element. Moreover, in some embodiments, the one of the plurality of teeth on which the second mating member is disposed extends rearwardly from an opening of the rotatable docking port in a direction substantially parallel to the axis of rotation of the rotatable docking port a further distance than each other teeth among the plurality of teeth.

In some embodiments, the first mating member extends inwardly along a radial direction relative to the longitudinal axis from an inner surface of the tubular spray element. In addition, in some embodiments, the second mating member extends outwardly along a radial direction relative to the axis of rotation of the rotatable docking port. In some embodiments, the rotatable docking port includes a diverter valve, and the second mating member is disposed on the diverter valve. Moreover, in some embodiments, the second mating member is disposed on a valve body of the diverter valve.

Consistent with another aspect of the invention, a dishwasher may include a wash tub, a rotatable conduit being rotatable about a longitudinal axis thereof and including a connector proximate an end thereof for receiving fluid, a docking port coupled to a wall of the wash tub and configured to removably engage with the connector of the rotatable conduit to supply fluid to the rotatable conduit, the docking port including a drive member that is rotatable about an axis of rotation, and a slip ring alignment arrangement including first and second mating members respectively coupled to the connector of the rotatable conduit and the drive member. The first and second mating members are movable along respective first and second circular paths within a common plane that is substantially transverse to the axis of rotation of the drive member when the connector of the rotatable conduit is received within the docking port such that rotation of the drive member in a first direction causes the first and second mating members to come into contact with one another to rotationally align the rotatable conduit relative to the drive member and thereafter rotate the rotatable conduit in the first direction while the first and second mating members are in contact with one another.

Also, in some embodiments, the rotatable conduit includes a tubular spray element including one or more apertures extending through an exterior surface thereof, and the dishwasher further includes a tubular spray element drive configured to selectively rotate the drive member to discretely direct the tubular spray element to each of a plurality of rotational positions about the longitudinal axis thereof. In some embodiments, the docking port is a rotatable docking port, and the drive member is coupled to a rotatable portion of the rotatable docking port. In addition, in some embodiments, the first and second mating members are sized and configured such that rotation of the rotatable docking port a full revolution establishes rotational alignment between the tubular spray element and the drive member irrespective of a rotational position of the tubular spray element when the connector is inserted into the docking port. Also, in some embodiments, the slip ring alignment arrangement enables the drive member to rotate relative to the tubular spray element prior to the first and second mating members coming into contact with one another.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
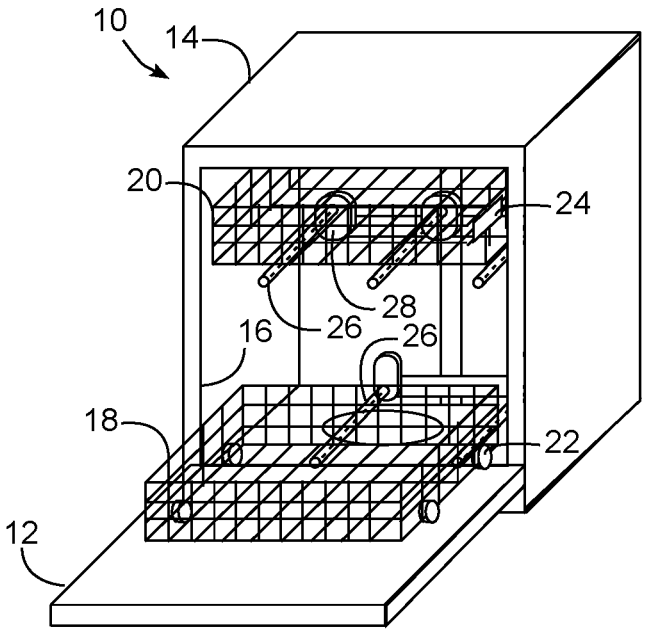
FIG. 1 is a perspective view of a dishwasher consistent with some embodiments of the invention.

In some embodiments consistent with the invention, a slip ring alignment arrangement is used to facilitate control over a rotational position of a rack-mounted tubular spray element or other rotatable conduit that is capable of being decoupled from a rotational drive, e.g., a rotational drive that drives a tubular spray element through a docking arrangement.

A tubular spray element, in this regard, may be considered to be a type of rotatable conduit that includes a body capable of communicating a fluid such as water, a wash fluid including water, detergent and/or another treatment composition, or pressurized air, and that is capable of communicating the fluid to one or more apertures or nozzles to spray fluid onto utensils within a wash tub. A tubular spray element generally includes an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates. Further, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, the tubular spray element may be operably coupled to such a drive through a support arrangement that both rotates the tubular spray element and supplies fluid to the tubular spray element, as will become more apparent below. Further details regarding tubular spray elements may be found, for example, in U.S. Pat. No. 10,531,781 to Digman et al., which is assigned to the same assignee as that of the present application, and which is incorporated by reference herein. In other embodiments, however, a tubular spray element may rotate in a less controlled fashion, e.g., through the use of an electric drive, a hydraulic drive, or based upon a force generated in reaction to the ejection of wash fluid from the tubular spray element itself. In such instances, the rotational position of a tubular spray element may not be discretely controlled and/or known at any given time, although other aspects of the rotation or operation of the tubular spray element may still be controlled in some embodiments, e.g., the speed of rotation, whether rotation is enabled or disabled, and/or whether fluid flow is provided to the tubular spray element, etc.

Dishwasher

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
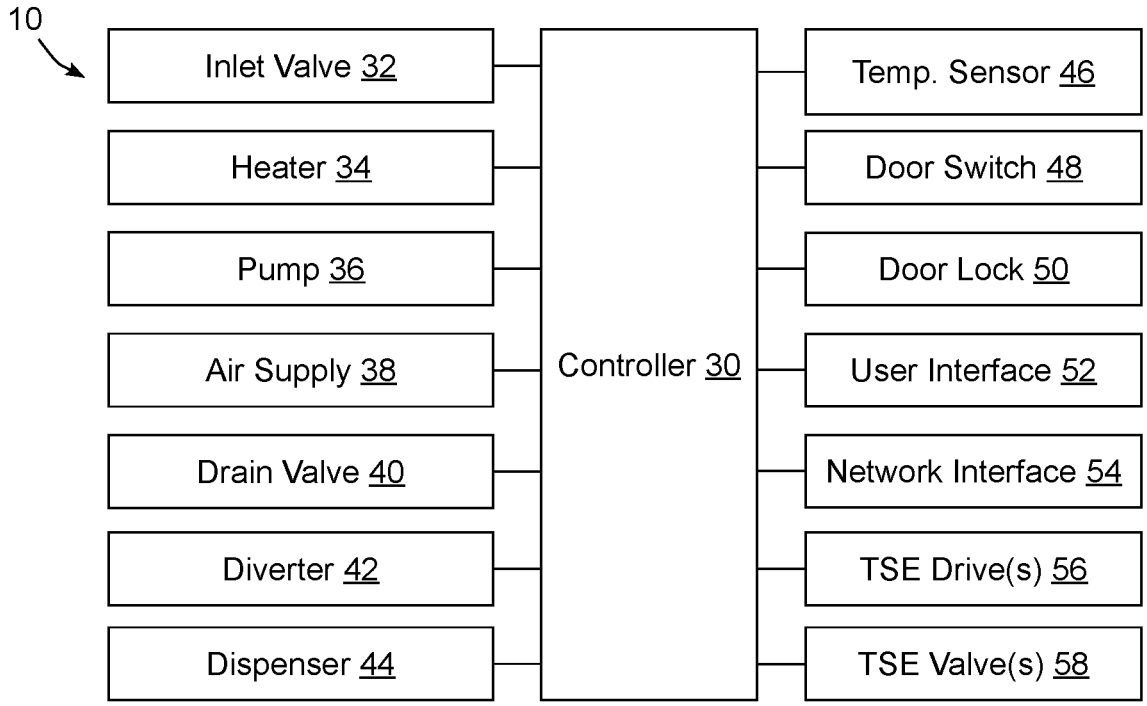
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more tubular spray element (TSE) drives 56 and/or one or more tubular spray element (TSE) valves 58 may be provided in some embodiments to discretely control one or more tubular spray elements disposed in dishwasher 10, as will be discussed in greater detail below.

It will be appreciated that each tubular spray element drive 56 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 58 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Tubular Spray Elements

Figure 3:
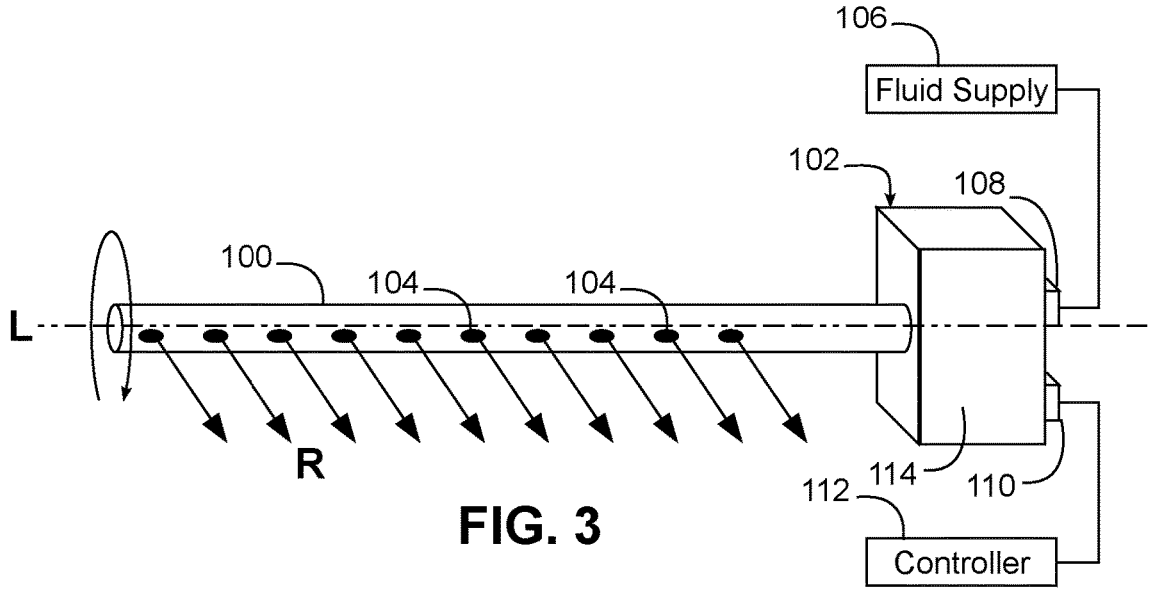
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102 that will be discussed in greater detail below. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
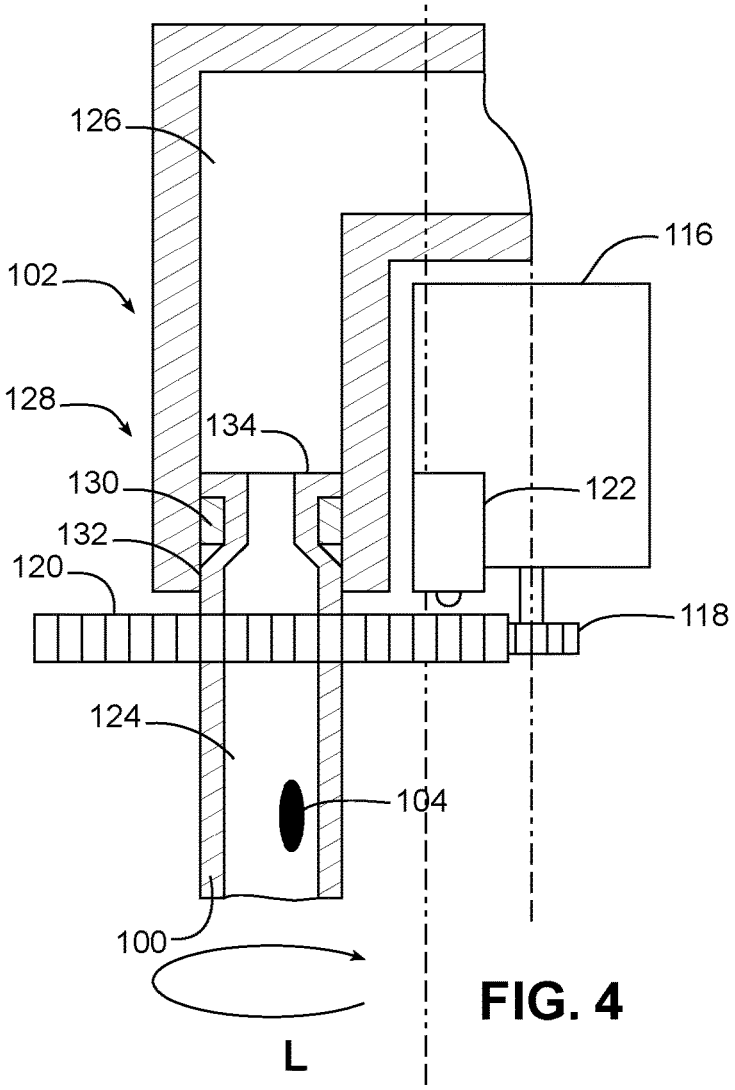
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pully drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

Figure 5:
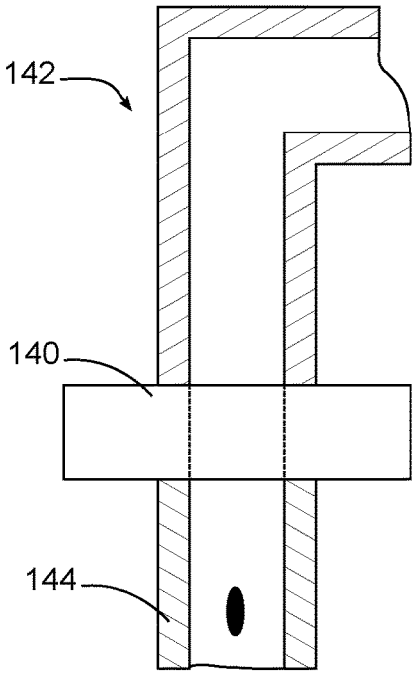
FIG. 5 is a partial cross-sectional view of another tubular spray element and tubular spray element drive consistent with some embodiments of the invention, and including a valve for restricting flow to the tubular spray element.

Turning to FIG. 5, it also may be desirable in some embodiments to incorporate a valve 140 into a tubular spray element drive 142 to regulate the fluid flow to a tubular spray element 144 (other elements of drive 142 have been omitted from FIG. 5 for clarity). Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 144 and tubular spray element drive 142. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 144, e.g., using an iris valve, butterfly valve, gate valve, plunger valve, piston valve, valve with a rotatable disc, ball valve, etc., and actuated by a solenoid, motor or other separate mechanism from the mechanism that rotates tubular spray element 144. In other embodiments, however, valve 140 may be actuated through rotation of tubular spray element 144. In some embodiments, for example, rotation of tubular spray element 144 to a predetermined rotational position may close valve 140, e.g., where valve 140 includes an arcuate channel that permits fluid flow over only a range of rotational positions. In other embodiments, a valve may be actuated through over-rotation of a tubular spray element, or through counter rotation of a tubular spray element. Further, in some embodiments, a valve may be variable, e.g., configured as an iris valve, to regulate fluid flow to the tubular spray element, and may be independently actuated from rotation of a tubular spray element in some embodiments (e.g., via a solenoid or motor), or may be actuated through rotation of a tubular spray element, e.g., through rotation to a predetermined position, an over-rotation, or a counter-rotation, using appropriate mechanical linkages. Other variations will be appreciated by those of ordinary skill having the benefit of the instant disclosure.

Figure 6:
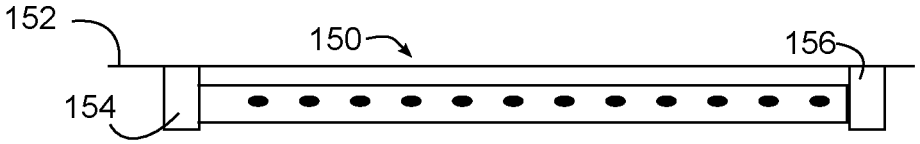
FIG. 6 is a functional top plan view of an example implementation of a wall-mounted tubular spray element and tubular spray element drive consistent with some embodiments of the invention.
Figure 7:
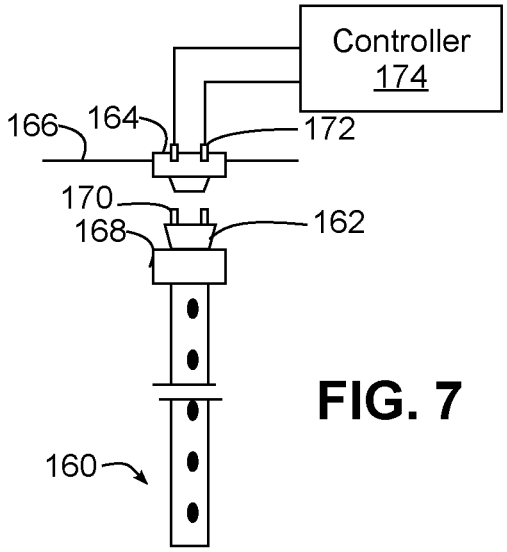
FIG. 7 is a functional top plan view of an example implementation of a rack-mounted tubular spray element and tubular spray element drive consistent with some embodiments of the invention.
Figure 8:
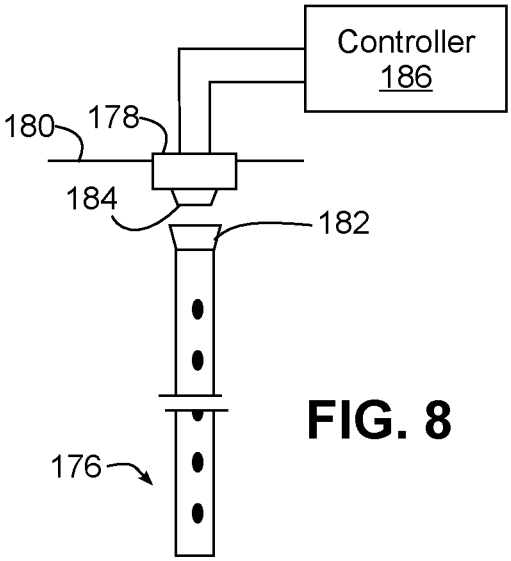
FIG. 8 is a functional top plan view of another example implementation of a rack-mounted tubular spray element and tubular spray element drive consistent with some embodiments of the invention.

Now turning to FIGS. 6-8, tubular spray elements may be mounted within a wash tub in various manners in different embodiments. As illustrated by FIGS. 1 and 3 (discussed above), a tubular spray element in some embodiments may be mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive.

Moreover, as illustrated by tubular spray element 150 of FIG. 6, rather than being mounted in a cantilevered fashion as is the case with tubular spray element 100 of FIG. 3, a tubular spray element may also be mounted on a wall 152 of a wash tub and supported at both ends by hubs 154, 156, one or both of which may include the components of the tubular spray element drive. In this regard, the tubular spray element 150 runs generally parallel to wall 152 rather than running generally perpendicular thereto, as is the case with tubular spray element 100 of FIG. 3.

In still other embodiments, a tubular spray element may be rack-mounted. FIG. 7, for example, illustrates a tubular spray element 160 mountable on rack (not shown) and dockable via a dock 162 to a docking port 164 on a wall 166 of a wash tub. In this embodiment, a tubular spray element drive 168 is also rack-mounted, and as such, in addition to a fluid coupling between dock 162 and docking port 164, a plurality of cooperative contacts 170, 172 are provided on dock 162 and docking port 164 to provide power to tubular spray element drive 168 as well as electrical communication with a controller 174.

As an alternative, and as illustrated in FIG. 8, a tubular spray element 176 may be rack-mounted, but separate from a tubular spray element drive 178 that is not rack-mounted, but is instead mounted to a wall 180 of a wash tub. A dock 182 and docking port 184 provide fluid communication with tubular spray element 176, along with a capability to rotate tubular spray element 176 about its longitudinal axis under the control of tubular spray element drive 178. Control over tubular spray element drive 178 is provided by a controller 186. In some instances, tubular spray element drive 178 may include a rotatable and keyed channel into which an end of a tubular spray element may be received.

Figure 9:
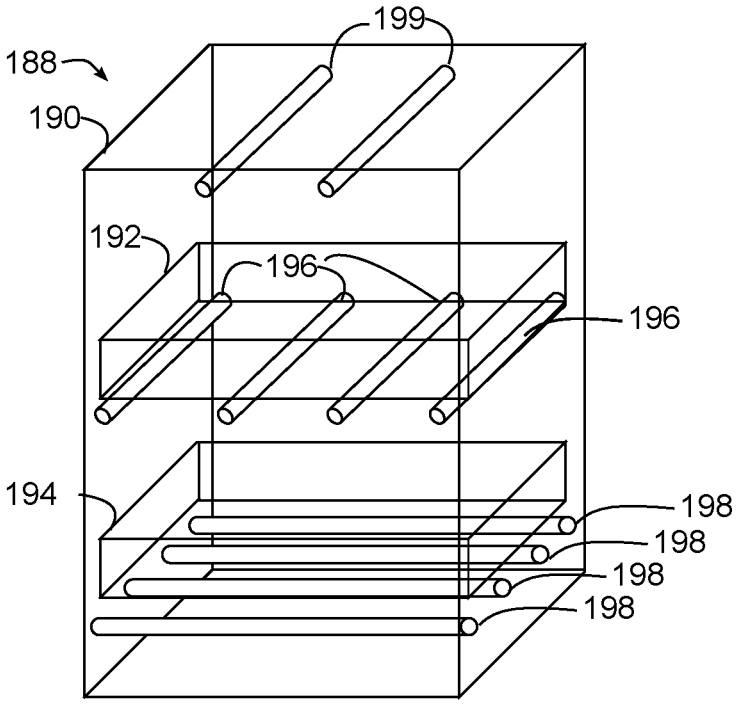
FIG. 9 is a functional perspective view of a dishwasher incorporating multiple tubular spray elements and consistent with some embodiments of the invention.

FIG. 9 next illustrates a dishwasher 188 including a wash tub 190 and upper and lower racks 192, 194, and with a number of tubular spray elements 196, 198, 199 distributed throughout the wash tub 190 for circulating a wash fluid through the dishwasher. Tubular spray elements 196 may be rack-mounted, supported on the underside of upper rack 192, and extending back-to-front within wash tub 190. Tubular spray elements 196 may also dock with back wall-mounted tubular spray element drives (not shown in FIG. 9), e.g., as discussed above in connection with FIG. 8. In addition, tubular spray elements 196 may be rotatably supported at one or more points along their respective longitudinal axes by couplings (not shown) suspended from upper rack 192. Tubular spray elements 196 may therefore spray upwardly into upper rack 192 and/or downwardly onto lower rack 194, and in some embodiments, may be used to focus wash fluid onto a silverware basket or other region of either rack to provide for concentrated washing. Tubular spray elements 198 may be wall-mounted beneath lower rack 194, and may be supported at both ends on the side walls of wash tub 190 to extend in a side-to-side fashion, and generally transverse to tubular spray elements 196. Each tubular spray element 196, 198 may have a separate tubular spray element drive in some embodiments, while in other embodiments some or all of the tubular spray elements 196, 198 may be mechanically linked and driven by common tubular spray element drives.

In some embodiments, tubular spray elements 196, 198 by themselves may provide sufficient washing action and coverage. In other embodiments, however, additional tubular spray elements, e.g., tubular spray elements 199 supported above upper rack 192 on one or both of the top and back walls of wash tub 190, may also be used. In addition, in some embodiments, additional spray arms and/or other sprayers may be used. It will also be appreciated that while 10 tubular spray elements are illustrated in FIG. 9, greater or fewer numbers of tubular spray elements may be used in other embodiments.

It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

Tubular Spray Element Slip Ring Alignment

Figure 10:
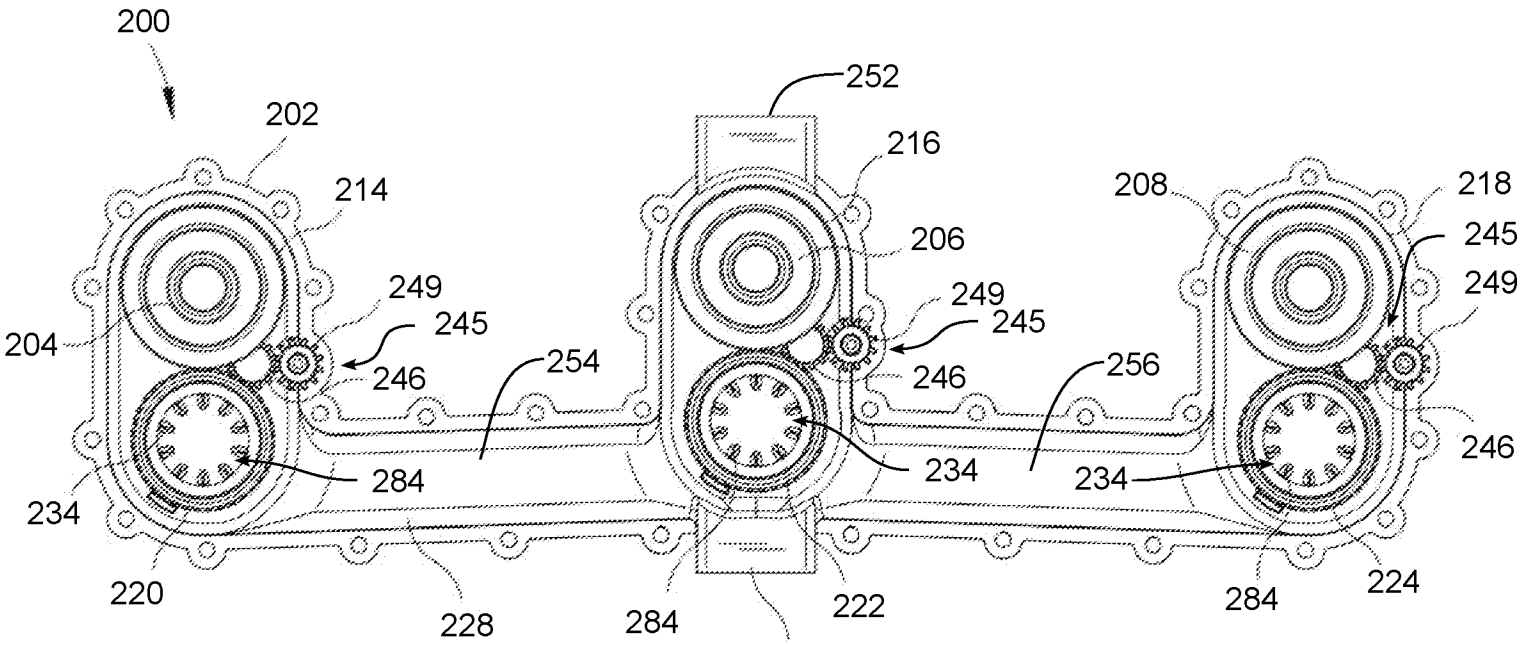
FIG. 10 is a front elevational view of an example embodiment of rack-mounted tubular spray elements docked to a docking arrangement consistent with some embodiments of the invention.
Figure 11:
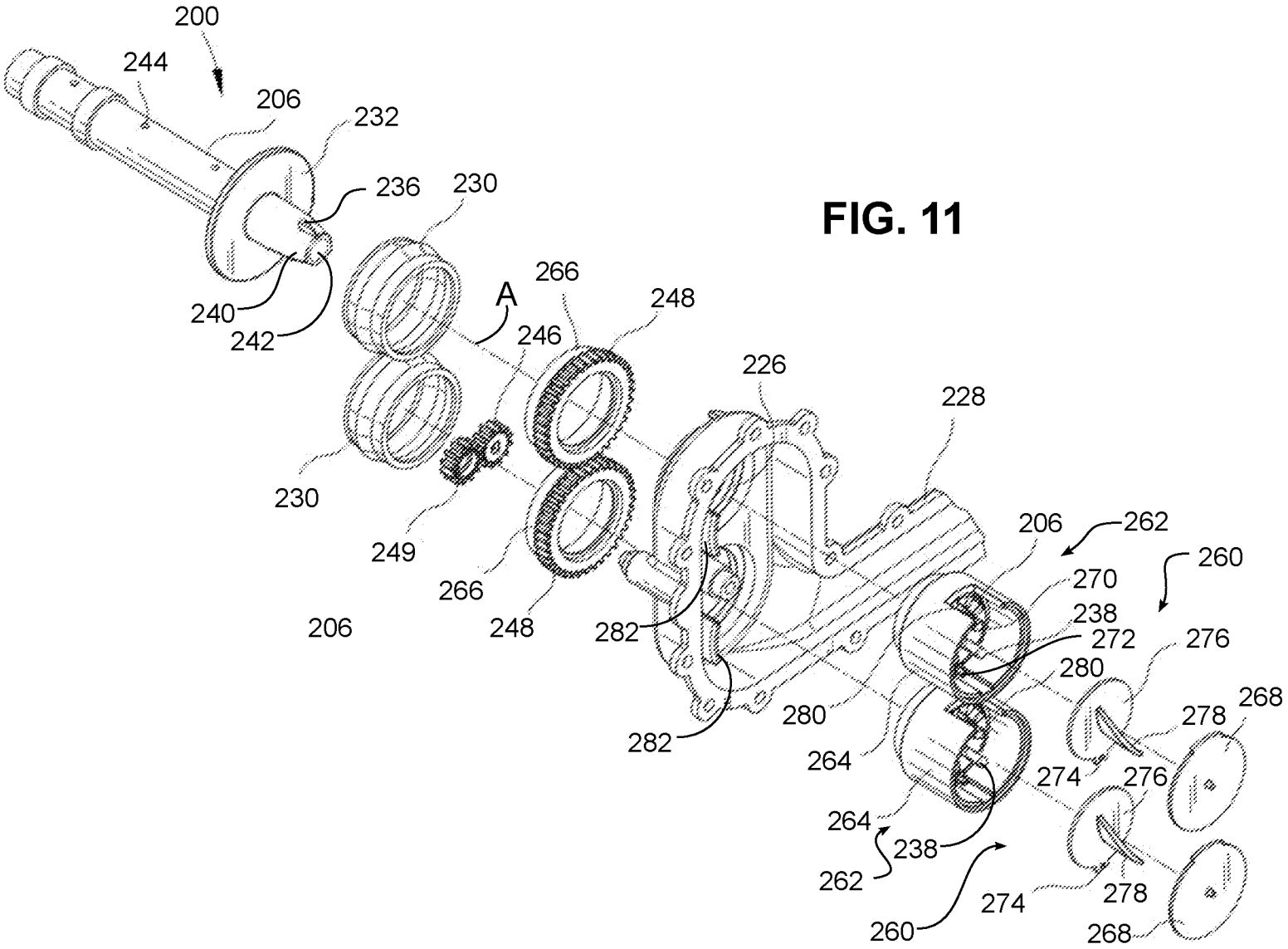
FIG. 11 is a rear exploded perspective view of a portion of the example embodiment of FIG. 10.
Figure 12:
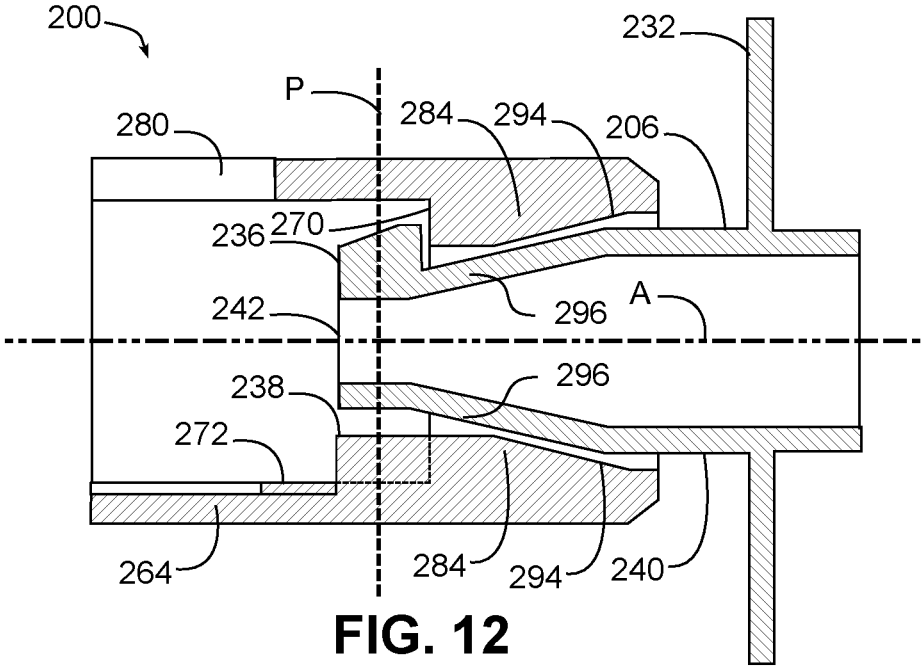
FIG. 12 is a cross-sectional view of a tubular spray element and valve body illustrated in FIG. 11.

Now turning to FIGS. 10-12, these figures illustrate an example rack-mounted tubular spray element system 200 suitable for use, for example, in dishwasher 10 of FIG. 1. Tubular spray element system 200 includes a docking arrangement 202 supporting docking with three rack-mounted tubular spray elements 204, 206, 208 rotatably supported on a rack (not shown). Tubular spray element system 200 is similar in many respects to that described, for example, in U.S. Pat. No. 10,631,708, which is assigned to the same assignee as the present application and is incorporated by reference herein.

In the illustrated embodiment, docking arrangement 202 includes multiple docking ports for each tubular spray element to support adjustment of the rack at multiple elevations in the wash tub, i.e., upper docking ports 214, 216, 218 and lower docking ports 220, 222, 224. In particular, in many dishwasher designs, it is desirable to enable a consumer to raise and lower the elevation of an upper rack in order to support different types of loads, e.g., where larger items need to be placed in the lower or upper rack. Various manners of adjusting the elevation of a rack may be used in different embodiments, as will be appreciated by those of ordinary skill in the art having the benefit of the instant disclosure. For the purposes of this example, it can be assumed that the rack supporting tubular spray elements 204, 206, 208 includes suitable mechanisms to move the rack between an upper elevation where tubular spray elements 204-208 are received in upper docking ports 214-218, and a lower elevation where tubular spray elements 204-208 are received in lower docking ports 220-224.

Also in the illustrated embodiment, each docking port 214-224 is rotatable about an axis of insertion of its respective tubular spray element (e.g., axis A of FIG. 11 for tubular spray element 206). Axis A may therefore be considered to additionally be an axis of rotation of both the docking port and its respective tubular spray element. In addition, axis A may also be considered to be a longitudinal axis for tubular spray element 206, although it will be appreciated that the longitudinal axis of a tubular spray element, the axis of insertion of the tubular spray element, the axis of rotation of the tubular spray element and the axis of rotation of the docking port need not all be coextensive with one another in other embodiments.

Each docking port 214-224 is rotatably received in a circular aperture 226 in a housing 228 that is secured to a rear wall of the wash tub. Each docking port 214-224 includes a gasket 230 configured to form a seal with a corresponding flange 232 on each tubular spray element 204-208, and may be configured as a bellows gasket in some embodiments. Furthermore, each docking port 214-224 includes a slip ring alignment arrangement 234, described in greater detail below, and including in the illustrated embodiment a pair of mating members 236, 238 disposed respectively on an end connector 240 of each tubular spray element 204-208 and a valve body 264 in each docking port 214-224 such that rotation of a docking port 214-224 causes rotation of the respective tubular spray element when connector 240 is received within the docking port. Furthermore, each connector 238 includes one or more inlet ports 242 to receive fluid from docking arrangement 202, with the respective gasket 230 providing a seal such that the fluid is conveyed through the tubular spray element and out of one or more apertures, nozzles or sprayers 244 along the surface of the tubular spray element.

Figure 13:
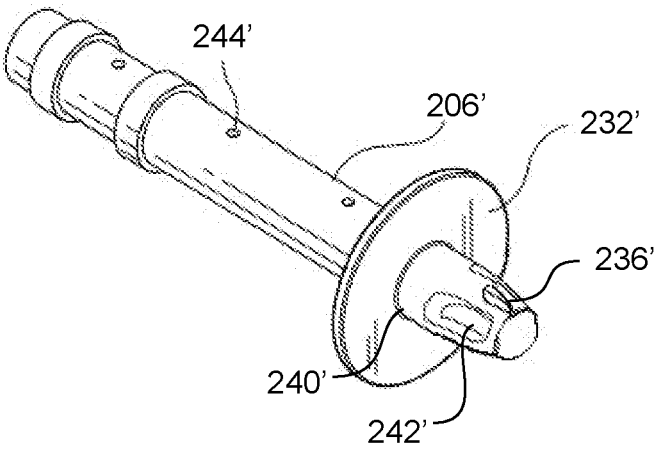
FIG. 13 is a perspective view of another example embodiment of a tubular spray element to that illustrated in FIG. 11.

It should be noted that inlet port 242 is illustrated in FIG. 11 as being disposed in an end surface of tubular spray element 206. In other embodiments, however, and as illustrated by tubular spray element 206' of FIG. 13, it may be desirable to utilize other inlet port geometries, e.g., to include one or more radially-facing inlet ports 242' on a side surface of an end connector 240' to convey fluid to one or more apertures 244'. As with tubular spray element 206, tubular spray element 206' may similarly be configured with a flange 232' and a mating member 236' suitable for use in a slip ring alignment arrangement as described herein.

Rotation of each docking port may be implemented using a docking port drive 245, which may be considered to be a type of rotational drive and/or a tubular spray element drive. Each docking port drive 245 in the illustrated embodiment may include a stepper motor or other type of electric motor, and may include a pinion gear 246 that is configured to engage a gear 248 formed on the outside surface of each docking port 214-224 such that one docking port drive is capable of concurrently driving both the upper and lower docking ports for a particular tubular spray element. An idler gear 249 may also be used in some embodiments to balance the load on each pinion gear 246.

As such, a total of three docking port drives are used for docking arrangement 202, thereby supporting individual control over the rotational position of each tubular spray element regardless of whether it is docked in the upper docking port or lower docking port. In other embodiments, one docking port drive may be coupled to drive multiple tubular spray elements, and in still other embodiments, separate docking port drives may be used to drive the upper and lower docking ports for a given tubular spray elements. Moreover, as discussed above, other motors and drives may be used as an alternative to stepper motors, and in some embodiments, separate position sensors may be used to sense the position of the tubular spray element.

Housing 228 of docking arrangement 202 may serve as a manifold to convey fluid to all of docking ports 214-224. Given housing 228's placement on the rear wall of the wash tub and at an intermediate elevation suitable for positioning tubular spray elements beneath and/or within an upper rack, housing 228 may include a lower inlet port 250 that receives fluid from a fluid supply (e.g., via a first generally vertical conduit disposed along the rear wall of the wash tub) as well as an upper outlet port 252 that conveys fluid to one or more upper sprayers (e.g., a ceiling-mounted spray arm or one or more tubular spray elements disposed above the upper rack). Furthermore, a pair of lateral channels 254, 256 convey fluid received from lower port 250 to docking ports 214, 218, 220 and 224 for side tubular spray elements 204 and 208. In other embodiments, other arrangements of ports may be used, e.g., no upper port if no sprayers are disposed above rack 210, or no lateral channels such that each docking port or each pair of upper and lower docking ports is supplied with fluid separately.

Each docking port in the illustrated embodiment may also include an integrated check valve 260 and integrated diverter valve 262. Each integrated check valve 260 is used to block fluid flow from a docking port when a tubular spray element is not coupled to the docking port, e.g., such that if rack 210 is in an upper elevation and tubular spray elements 204-208 are engaged with upper docking ports 214-218, the check valves 260 for each of lower docking ports 220-224 will remain closed so that fluid does not flow through the lower docking ports. Each integrated diverter valve 262 is used to control fluid flow to a tubular spray element based upon a rotational position of the docking port, i.e., so that fluid flow is controllably allowed or restricted at predetermined rotational positions of the docking port, and thus, the tubular spray element coupled thereto.

To support both types of valves, each docking port in the embodiment illustrated in FIGS. 10-12 includes a valve body 264 that is positioned in the interior of housing 228 and that engages a gear body 266 that is exterior of housing 228 through an aperture 226 in housing 228, e.g., via a snap or press fit arrangement, using adhesives and/or fasteners, or in other manners that will be apparent to those of ordinary skill having the benefit of the instant disclosure. Gasket 230 is secured to gear body 266, while a cover 268 is secured to valve body 264 to form a rear surface thereof, e.g., via a snap or press fit arrangement, using adhesives and/or fasteners, or in other manners that will be apparent to those of ordinary skill having the benefit of the instant disclosure.

With respect to check valve 260, valve body 264 includes an annular valve seat 270 and a projection 272 that is configured to retain a tab 274 of a flap 276 that functions as a check valve for the docking port. In the illustrated embodiment, valve body 264 is generally cylindrical in cross-section, and as such a main portion of flap 276 is circular in shape to form a seal along the perimeter of annular valve seat 270 when closed. It will also be appreciated that flap 276 in the illustrated embodiment rotates with valve body 264, although in some embodiments a check valve may not rotate with the valve body.

Flap 276 also includes a biasing member 278, here implemented as a transverse fin, that biases flap 276 to a closed position when the end connector 240 of a tubular spray element is not engaged with the docking port. Biasing member 278 pushes against rear cover 268 to maintain check valve 260 in a closed position, and upon insertion of end connector 240 of a tubular spray element, flap 276 is displaced rearwardly to disengage from valve seat 270 and open check valve 260. Biasing member 278 may fold over or otherwise bend as the biasing force is overcome by the insertion of end connector 240. As such, it may be desirable in some embodiments to form biasing member 278 integrally with flap 276, e.g., using silicone, rubber, or another suitable elastomeric material.

In addition, with respect to diverter valve 262, valve body 264 includes an inlet 280 for receiving fluid. In the illustrated embodiment, inlet 280 is formed in a substantially cylindrical sidewall of valve body 264 such that inlet 280 is a radially-facing inlet as the inlet faces generally in a radial direction from the rotational axis of the valve body. In other embodiments, however, an inlet may be formed elsewhere on a valve body, e.g., on a rear surface such as on cover 268. In either instance, the inlet rotates with the valve body such that fluid flow may be received at various rotational positions about the rotational axis. In addition, in the illustrated embodiment, each inlet 280 faces in generally the same direction as the apertures 244 of an associated tubular spray element, although the invention is not so limited.

Each diverter valve 262 additionally includes one or more valve members, e.g., valve members 282, that effectively operate to selectively restrict fluid flow through inlet 280 when valve body 264 is rotated to a position facing such valve members. In this regard, although the valve members 282 are in fixed positions and the valve bodies 264 are rotatable, the sidewall of each valve body circumscribing the inlet effectively operates as a valve seat that is selectively blocked by a fixed position valve member. Each valve member 282 is disposed at a predetermined rotational position (or range of rotational positions) as well as a predetermined radius (or range of radii) such that when valve body 264 is rotated to a position where inlet 280 is directly opposite a valve member, flow through the inlet is restricted or even stopped entirely. In the illustrated embodiment where inlet 280 is a radially-facing inlet, each valve member 282 includes a mating surface that faces the valve body and is generally arcuate in cross-section, with the mating surface extending circumferentially around the valve body at a predetermined radius from the axis of rotation to substantially block flow through the inlet when the inlet is rotated to the predetermined rotational position of the valve member. As such, the predetermined radius for the valve member may be selected to match that of the sidewall of the valve body while still allowing for relative rotation therebetween.

In some embodiments, valve members 282 may be used to restrict fluid flow in particular directions, e.g., to avoid directing a spray against a tub wall or in other directions that are not useful or are otherwise unused in a wash cycle. In other embodiments, however, valve members 282 may be used to effectively shut off particular tubular spray elements during different portions of a wash cycle. For example, it may be desirable in some embodiments to alternate between different tubular spray elements or other sprayers to increase the fluid pressure and flow to a reduced number of tubular spray elements or sprayers. It may also be desirable in some embodiments to perform more focused spraying in particular regions of a wash tub using one or more tubular spray elements, with other tubular spray elements effectively shut off to increase the pressure and flow rate available to that limited number of tubular spray elements. The selective use of subsets of sprayers may in some embodiments decrease the flow requirements for the dishwasher pump and/or decrease energy consumption in the dishwasher. Put another way, the selective use of subsets of sprayers in some embodiments may maintain a combined output of all of the sprayers in a dishwasher within an output envelope of the fluid supply. In addition, it may be desirable in some embodiments to rotate a valve body to only partially restrict flow through an inlet 280 by rotating the valve body such that the valve member only partially blocks the fluid inlet. Doing so would regulate flow rate and thereby enable different flow rates to be provided for different tubular spray elements if desired. Furthermore, in some embodiments pump pressure or speed may be varied to vary pump performance based upon whether sprayers are being used concurrently or individually.

It will be appreciated by those of ordinary skill having the benefit of the instant disclosure that other check and/or diverter valve designs, including but not limited to those described in the aforementioned 708 patent, may be used in connection with tubular spray element docking ports in other embodiments, and therefore, the invention is not limited to the specific implementations discussed herein. Furthermore, it will be appreciated that the various docking ports described herein may be used in groups of three or more to support additional rack elevations, or may be used singularly in connection with a non-adjustable rack. Furthermore, it will be appreciated that many of the various components discussed herein may be used in connection with rotatable conduits other than the tubular spray elements discussed above. In particular, rotatable docking ports consistent with the invention and/or the various check and/or diverter valves discussed herein may be utilized in connection with other types of rack-mounted conduits to support rotation of the conduits along with supplying fluid thereto. A conduit, in this regard, may be considered to include any component including one or more channels for communicating fluid. A conduit may include one or more apertures, nozzles or sprayers in some embodiments, while in other embodiments, a conduit may merely communicate fluid to another component, and itself may have no openings for spraying fluid onto utensils in a wash tub. As one example, a conduit may be mechanically coupled to a separate spray arm or other sprayer mounted in a rack (e.g., via one or more gears) such that rotation of the conduit imparts movement to the attached spray arm or sprayer. In addition, while tubular spray elements are illustrated as being predominantly cylindrical in nature, conduits in other embodiments may have other profiles and shapes, so the invention is not so limited. Moreover, it will be appreciated by those of ordinary skill having the benefit of the instant disclosure that many of the techniques and components discussed herein may be utilized in connection with non-rotatable docking ports and non-rotatable conduits. Additional variations will be appreciated by those of ordinary skill having the benefit of the instant disclosure.

With additional reference to FIG. 12, as noted above, a slip ring alignment arrangement 234 may be used in the illustrated embodiments to facilitate alignment of a tubular spray element with a rotational drive such as a tubular spray element or docking port drive. It will be appreciated, in particular, that in embodiments for which it is desirable to discretely direct a tubular spray element to a controlled rotational position, some mechanism or functionality is generally needed to enable the rotational position of the tubular spray element to be known or otherwise set relative to a tubular spray element drive. For wall-mounted tubular spray elements, the rotational position of a tubular spray element relative to a rotational drive generally may be fixed at manufacture. This, however, is not necessarily the case for tubular spray elements or other rotatable conduits that are capable of being decoupled from a rotational drive, e.g., in embodiments where a tubular spray element is rack-mounted and the rotational drive is not, such that the tubular spray element effectively moves in an axial direction whenever the rack upon which it is supported is pulled out to a loading/unloading position.

In particular, while it is possible and even in some instances more likely that a rack-mounted tubular spray element will not be disturbed when a rack is pulled out to a loading position and then returned to its washing position, it is still possible that the tubular spray element could be rotated either intentionally or inadvertently whenever the tubular spray element is decoupled from the rotational drive. For example, taller utensils disposed in a lower rack could potentially engage with a tubular spray element mounted to an upper rack when either rack is being moved and cause some rotation of the tubular spray element from its prior rotational position.

In embodiments consistent with the invention, however, a slip ring alignment arrangement as described herein may be used to reestablish a known alignment between a rotational drive such as a tubular spray element and/or rotatable docking port drive and a tubular spray element after the tubular spray element is recoupled to the rotational drive.

In particular, in some embodiments consistent with the invention, and as illustrated in FIGS. 10-12, a docking arrangement 202 mounted on the wall of a dishwasher wash tub may engage with a connector 240 of a rack-supported tubular spray element 206 when the rack is in the washing position to supply fluid to the tubular spray element 206. A rotatable docking port 216 is rotatable about an axis of rotation A and positioned to receive connector 240 of tubular spray element 206 when the rack is disposed in the washing position. A rotational drive, e.g., a docking port drive 245 may be configured to rotate docking port 216 such that when connector 240 of tubular spray element 206 is received in docking port 216, docking port drive 245 rotates tubular spray element 206 while rotating docking port 216.

In addition, a slip ring alignment arrangement 234, including first and second mating members 236, 238, may be used to removably couple tubular spray element 206 and docking port 216. A slip ring alignment arrangement, in this regard, may be considered to be any mechanical coupling that engages two rotational elements when one of the two rotational elements is rotated to a predetermined rotational position relative to the other rotational element such that continued rotation in the same direction causes both rotational elements to rotationally align with one another in a predetermined rotational relationship to one another, while rotation of the one rotational element while the two rotational elements are not in the predetermined rotational relationship allows the one rotational element to "slip"

relative to the other rotational element and thereby rotate without also causing rotation of the other rotational element. One benefit of such a slip ring alignment arrangement is that the rotational orientations of the two rotational elements need not be known or controlled when the two rotational elements are initially engaged with one another, as the predetermined rotational relationship can generally be achieved by rotating one of the rotational elements a full revolution to ensure that the predetermined rotational relationship has been achieved. Thus, from the perspective of a rack-mounted tubular spray element that can potentially be inadvertently rotated when decoupled from a docking port, the use of a slip ring alignment arrangement enables a predetermined rotational relationship to be established between the tubular spray element and the docking port simply through rotation of the docking port for a full revolution, and so long as the rotational position of the docking port is known or tracked and the rotational offset between the tubular spray element and the docking port when the two components are in rotational alignment with one another is known (e.g., based upon the geometry of the components), the rotational position of the tubular spray element can likewise be known or tracked.

For the purposes of this disclosure, the term "full revolution" within the context of the invention may refer to that amount of relative rotation between two rotational elements where it can be assured that the predetermined rotational relationship between the two rotational elements can be established, regardless of the initial rotational positions of each of the two elements. In some embodiments, for example, a full revolution may refer to 360 degrees of motion. However, in other embodiments, a full revolution may be less than 360 degrees to account for angular "widths" of the mating members used in the slip ring alignment arrangement. If, for example, each mating member has a width that occupies 3 degrees of motion, the combined widths of the mating members corresponds to 6 degrees of motion, so a full revolution that ensures that the two rotational elements will achieve the predetermined rotational relationship in such a circumstance may be satisfied by a rotation of only 354 degrees.

In the illustrated embodiment, first mating member 236 of slip ring alignment mechanism 234 is coupled to connector 240 of tubular spray element 206, while second mating member 238 is coupled to docking port 216, and in particular to valve body 264 thereof, which additionally functions as a drive member. In addition, with additional reference to FIG. 14A, each mating member 236, 238 rotates along a circular path C1, C2 and within a common plane P (see FIG. 12) that is substantially transverse to axis A, which may be considered to be both the axis of rotation of docking port 216 and the longitudinal axis of tubular spray element 206. By doing so, regardless of the relative rotational positions of mating members 236, 238 when connector 240 of tubular spray element 206 is inserted into docking port 216, rotation of docking port 216 will cause mating members 236, 238 to eventually come into contact with one another to rotationally align tubular spray element 206 relative to docking port 216, such that further rotation of docking port 216 in the same direction will additionally rotate tubular spray element 206.

In addition, while not required in all embodiments, a slip ring alignment arrangement consistent with the invention may also define separate rotational alignments for different directions of rotation. Thus, once rotational alignment associated with one direction of rotation is established between a tubular spray element and a docking port, a full revolution in the opposite direction may be used to establish a different rotational alignment based upon different portions or mating surfaces of the mating members (or even different mating members in some embodiments).

Figure 14A:
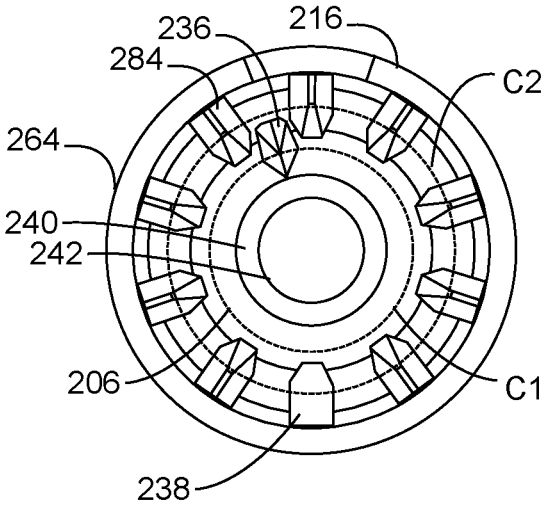
FIGS. 14A-14D are end elevational views illustrating different positions of a slip ring alignment arrangement formed by the tubular spray element and valve body of FIG. 12.

FIGS. 14A-14D, for example, illustrate the establishment of different rotational alignments between tubular spray element 206 and docking port 216. FIG. 14A, for example, illustrates end connector 240 of tubular spray element 206 inserted into valve body 264 of docking port 216 in an arbitrary rotational position. In this embodiment, and with further reference to FIGS. 10-12, mating member 236 is defined as a projection that extends outwardly from an outer surface of connector 240 along a radial direction relative to longitudinal axis A of tubular spray element 206. Mating member 238, on the other hand, is defined on one of a plurality of teeth 284 that are formed in an annular array about the perimeter of valve body 264 (and thus also of docking port 216) and that extend in radial directions relative to axis A and inwardly from the perimeter of the valve body.

During insertion of connector 240 into valve body 264, mating member 236 is sized, configured, and otherwise disposed to fit between the gaps in the teeth 284, and to facilitate this passage, it may be desirable in some embodiments to incorporate various bevels, slopes or chamfers on these components to deflect mating member 236 during insertion should it contact a tooth 284 during insertion. When fully inserted, however, and as is illustrated in FIG. 12, mating member 236 is positioned beyond all of teeth 284 with the exception of one tooth upon which is defined mating member 238, which extends rearwardly a further distance from the front or opening of docking port 216 (i.e., the side from which the tubular spray element is inserted) than the other teeth. By doing so, the other teeth 284 are out of the path of rotation of mating member 236 and thus, it will be appreciated that, in the orientation illustrated in FIG. 14A, any rotation of valve body 264 will not also cause a corresponding rotation of tubular spray element 206.

Figure 14B:
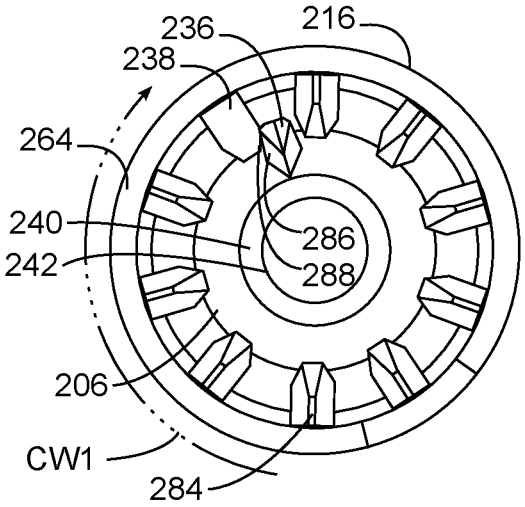
Figure 14C:
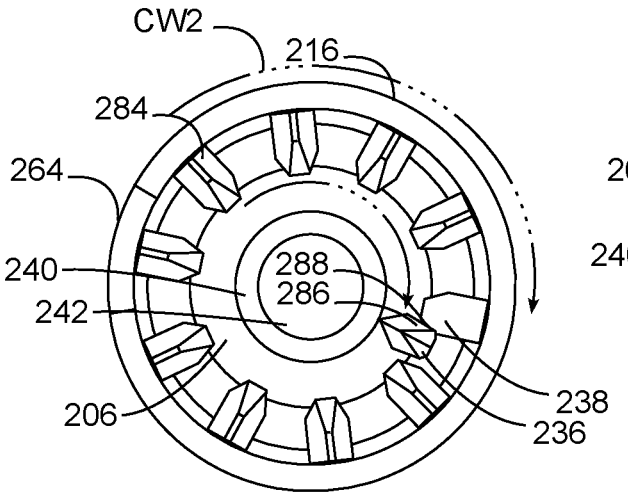

As shown in FIG. 14B, rotation of valve body 264 in a clockwise direction represented by arrow CW1 does not cause a corresponding rotation of tubular spray element 206, but does eventually bring a mating surface 286 of mating member 236 into contact with a cooperative mating surface 288 of mating member 238, which brings the tubular spray element into rotational alignment with valve body 264. Thereafter, as illustrated in FIG. 14C, further rotation of valve body 264 in a clockwise direction (represented by arrow CW2) causes corresponding rotation of tubular spray element 206, thereby maintaining the same rotational alignment between the tubular spray element and the valve body throughout the rotation. Thus, if the rotational position of the valve body is known or tracked (e.g., with a position sensor), the rotational position of the tubular spray element can also be determined, and thus controlled, e.g., to discretely direct the tubular spray element to focus spray in a particular direction.

Figure 14D:
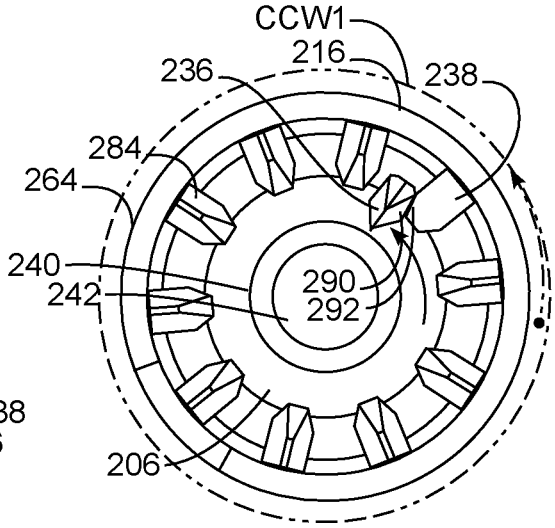

As illustrated in FIG. 14D, if it is desirable to change the direction of rotation, e.g., to rotate in a counter-clockwise direction, a full revolution in the counter-clockwise direction (represented by arrow CCW1) may be performed to establish a different rotational alignment between tubular spray element 206 and valve body 264. Doing so brings different mating surfaces 290, 292 on mating members 236, 238 into contact with one another, and further rotation beyond this point results in the same rotational alignment being maintained as both tubular spray element 206 and valve body 264 rotate in the clockwise direction.

It may also be desirable in some embodiments to utilize a centering chamfer in a docking port to facilitate centering of connector 240 of tubular spray element 206 during insertion. In the embodiment illustrated in FIGS. 10-12, for example, surfaces 294 of teeth 284 may together form a centering chamfer, while corresponding surfaces 296 on connector 240 may have a similar inclination to facilitate centering of the tubular spray element.

Figure 15:
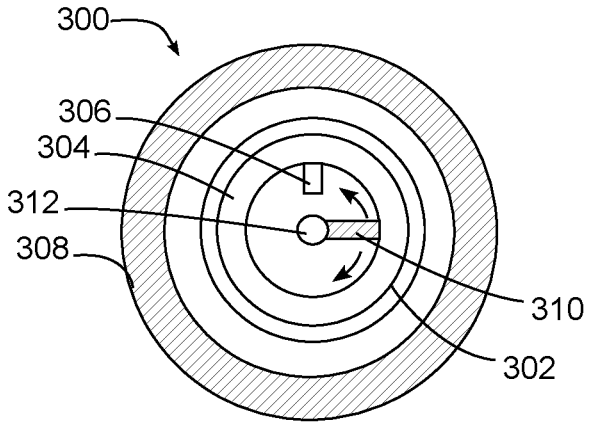
FIG. 15 is a cross-sectional view of a tubular spray element and valve body incorporating an alternate slip ring alignment arrangement to that illustrated in FIG. 12.

It will be appreciated that a slip ring alignment arrangement may be configured differently in other embodiments. For example, rather than having a mating member of a tubular spray element that projects radially outwardly and a mating member of a docking port that projects radially inwardly, an alternate slip ring alignment arrangement such as arrangement 300 of FIG. 15 may be used. In this arrangement, a tubular spray element or other rotatable conduit 302 includes a connector 304 upon which is disposed a mating member 306 that extends inwardly along a radial direction relative to the longitudinal axis of the tubular spray element from an inner surface thereof. A docking port 308 includes a mating member 310 defined on a centrally-located rotatable driving member 312 and extending outwardly along a radial direction relative to the axis of rotation of the driving member of the docking port.

Other slip ring alignment arrangements may be used in other embodiments, as will be appreciated by those of ordinary skill having the benefit of the instant disclosure, including different directions of projection, sizes, shapes, or orientations for each mating member, different mounting locations for each mating member, etc. Therefore, the invention is not limited to the particular configurations illustrated herein.

Figure 16:
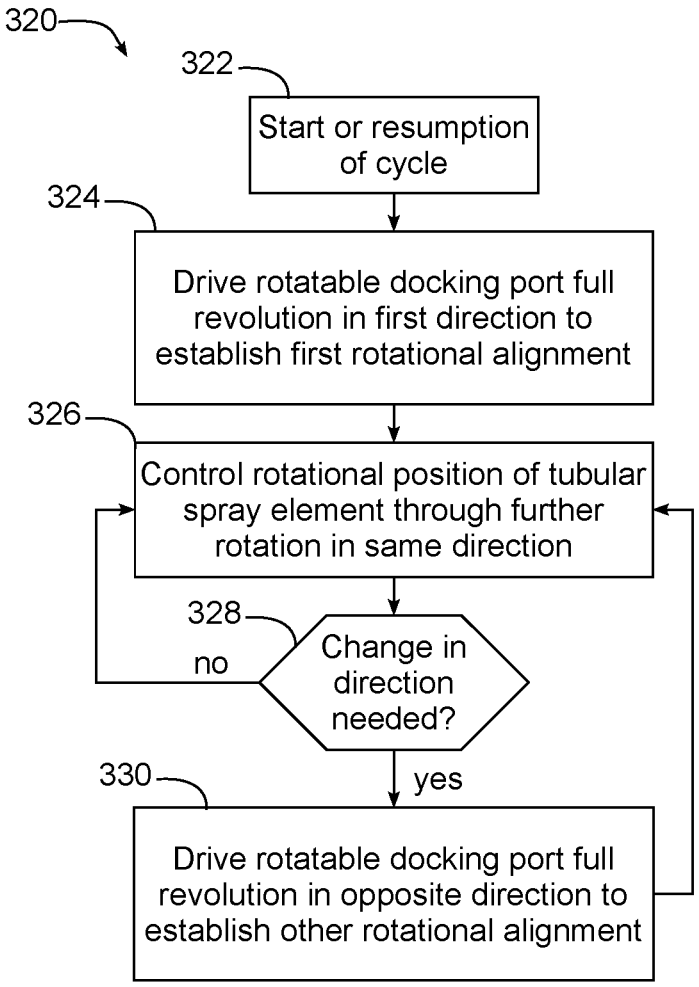
FIG. 16 is a flowchart illustrating an example sequence of operations for controlling a tubular spray element with a slip ring alignment arrangement consistent with some embodiments of the invention.

In operation, a controller of a dishwasher such as dishwasher 10 may control a tubular spray element in a manner illustrated by sequence of operations 320 of FIG. 16. In particular, as illustrated by block 302, at the start of a wash cycle, or any time the wash cycle is resumed (e.g., after the door has been opened and there is a potential that the tubular spray element has been decoupled and recoupled to the docking port), the rotatable docking port may be driven a full revolution in a first direction to establish the rotational alignment for that direction (block 324). Thereafter, the rotational position of the tubular spray element may be controlled through further rotation of the rotatable docking port in the same direction (block 326). If, at any time, rotation in the opposite direction is desired or needed (block 328), the rotatable docking port may be driven a full revolution in the opposite direction to establish the rotational alignment for the other direction (block 330), and control can return to block 326 to control the rotational position of the tubular spray element through further rotation in the same direction.

Other modifications may be made to the illustrated embodiments without departing from the spirit and scope of the invention. Therefore, the invention lies in the claims hereinafter appended.

What is claimed is:

1. A dishwasher, comprising:

a wash tub;

a rack supported in the wash tub and movable between loading and washing positions;

a tubular spray element supported by the rack for movement with the rack, the tubular spray element being rotatable about a longitudinal axis thereof and including a connector proximate an end thereof and one or more spray apertures extending through an exterior surface thereof; and a docking arrangement coupled to a wall of the wash tub and configured to engage with the connector of the tubular spray element when the rack is in the washing position to supply fluid to the tubular spray element, the docking arrangement including:

a rotatable docking port rotatable about an axis of rotation and positioned to receive the connector of the tubular spray element when the rack is disposed in the washing position; and a docking port drive coupled to the rotatable docking port and configured to rotate the rotatable docking port such that when the connector of the tubular spray element is received in the rotatable docking port, the docking port drive rotates the tubular spray element while rotating the rotatable docking port;

wherein the tubular spray element and the rotatable docking port are coupled to one another through a slip ring alignment arrangement including first and second mating members respectively coupled to the connector of the tubular spray element and the rotatable docking port, the first and second mating members being movable along respective first and second circular paths within a common plane that is substantially transverse to the axis of rotation of the rotatable docking port when the connector of the tubular spray element is received within the rotatable docking port such that rotation of the rotatable docking port by the docking port drive in a first direction causes the first and second mating members to come into contact with one another to rotationally align the tubular spray element relative to the rotatable docking port and thereafter rotate the tubular spray element in the first direction while the first and second mating members are in contact with one another.

2. The dishwasher of claim 1, wherein the first and second mating members are sized and configured such that rotation of the rotatable docking port a full revolution establishes rotational alignment between the tubular spray element and the rotatable docking port irrespective of a rotational position of the tubular spray element when the connector is inserted into the rotatable docking port.

3. The dishwasher of claim 1, wherein the slip ring alignment arrangement enables the rotatable docking port to rotate relative to the tubular spray element prior to the first and second mating members coming into contact with one another.

4. The dishwasher of claim 1, wherein the docking port drive is configured to rotate the rotatable docking port at least a full revolution in the first direction after insertion of the connector of the tubular spray element into the rotatable docking port to establish rotational alignment between the tubular spray element and the rotatable docking port.

5. The dishwasher of claim 4, wherein the rotational alignment established from rotation of the rotatable docking port in the first direction is a first rotational alignment, wherein further rotation of the rotatable docking port after establishing the first rotational alignment in the first direction drives rotation of the tubular spray element in the first direction, and wherein the docking port drive is further configured to rotate the rotatable docking port at least a full revolution in a second direction that is opposite the first direction after establishing the first rotational alignment between the tubular spray element and the rotatable docking port to bring different portions of the first and second mating members into contact with one another and thereby establish a second rotational alignment between the tubular spray element and the rotatable docking port.

6. The dishwasher of claim 5, wherein the first and second mating members each have first and second respective mating surfaces, the first mating surfaces of the first and second mating members configured to contact one another when the first rotational alignment is established and the second mating surfaces of the first and second mating members configured to contact one another when the second rotational alignment is established.

7. The dishwasher of claim 5, wherein the docking port drive is configured to discretely direct the tubular spray element to each of a plurality of rotational positions about the longitudinal axis thereof, and wherein the docking port drive is configured to reverse a rotational direction of the tubular spray element when the first rotational alignment is established by rotating the rotatable docking port a sufficient amount in the second direction to establish the second rotational alignment.

8. The dishwasher of claim 1, wherein the rotatable docking port includes a centering chamfer configured to center the tubular spray element in the rotatable docking port during insertion of the connector thereof.

9. The dishwasher of claim 8, wherein the centering chamfer is defined on a plurality of teeth extending in respective radial directions from the axis of rotation of the rotatable docking port and arranged in an annular array about a perimeter of the rotatable docking port, wherein the first mating member is sized and configured to fit between the plurality of teeth during insertion and removal of the connector of the tubular spray element into and out of the rotatable docking port.

10. The dishwasher of claim 9, wherein the second mating member is disposed on one of the plurality of teeth, and wherein the first mating member extends from an outer surface of the connector of the tubular spray element in a radial direction from the longitudinal axis of the tubular spray element.

11. The dishwasher of claim 10, wherein the one of the plurality of teeth on which the second mating member is disposed extends rearwardly from an opening of the rotatable docking port in a direction substantially parallel to the axis of rotation of the rotatable docking port a further distance than each other teeth among the plurality of teeth.

12. The dishwasher of claim 1, wherein the first mating member extends inwardly along a radial direction relative to the longitudinal axis from an inner surface of the tubular spray element.

13. The dishwasher of claim 12, wherein the second mating member extends outwardly along a radial direction relative to the axis of rotation of the rotatable docking port.

14. The dishwasher of claim 1, wherein the rotatable docking port includes a diverter valve, wherein the second mating member is disposed on the diverter valve.

15. The dishwasher of claim 14, wherein the second mating member is disposed on a valve body of the diverter valve.

16. A dishwasher, comprising:

a wash tub;

a rotatable conduit being rotatable about a longitudinal axis thereof and including a connector proximate an end thereof for receiving fluid;

a docking port coupled to a wall of the wash tub and configured to removably engage with the connector of the rotatable conduit to supply fluid to the rotatable conduit, the docking port including a drive member that is rotatable about an axis of rotation; and a slip ring alignment arrangement including first and second mating members respectively coupled to the connector of the rotatable conduit and the drive member, the first and second mating members being movable along respective first and second circular paths within a common plane that is substantially transverse to the axis of rotation of the drive member when the connector of the rotatable conduit is received within the docking port such that rotation of the drive member in a first direction causes the first and second mating members to come into contact with one another to rotationally align the rotatable conduit relative to the drive member and thereafter rotate the rotatable conduit in the first direction while the first and second mating members are in contact with one another.

17. The dishwasher of claim 16, wherein the rotatable conduit comprises a tubular spray element including one or more apertures extending through an exterior surface thereof, and wherein the dishwasher further comprises a tubular spray element drive configured to selectively rotate the drive member to discretely direct the tubular spray element to each of a plurality of rotational positions about the longitudinal axis thereof.

18. The dishwasher of claim 17, wherein the docking port is a rotatable docking port, and wherein the drive member is coupled to a rotatable portion of the rotatable docking port.

19. The dishwasher of claim 18, wherein the first and second mating members are sized and configured such that rotation of the rotatable docking port a full revolution establishes rotational alignment between the tubular spray element and the drive member irrespective of a rotational position of the tubular spray element when the connector is inserted into the docking port.

20. The dishwasher of claim 18, wherein the slip ring alignment arrangement enables the drive member to rotate relative to the tubular spray element prior to the first and second mating members coming into contact with one another.

* * * * *